United States Patent [19]

Mason et al.

[11] Patent Number: 5,003,294

[45] Date of Patent: Mar. 26, 1991

[54] REMOTE INFRA-RED PERSONAL ALARM SYSTEM

[75] Inventors: John Mason, Wakefield; Philip G. Hemming, Cleckheaton; Richard Caley, Wakefield; David Lang, Barnsley, all of England

[73] Assignee: Wakefield Health Authority, Wakefield, United Kingdom

[21] Appl. No.: 391,533

[22] PCT Filed: Jan. 20, 1988

[86] PCT No.: PCT/GB88/00038

§ 371 Date: Jul. 20, 1989

§ 102(e) Date: Jul. 20, 1989

[87] PCT Pub. No.: WO88/05580

PCT Pub. Date: Jul. 28, 1988

[30] Foreign Application Priority Data

Jan. 20, 1987 [GB] United Kingdom ..... 8701202

[51] Int. Cl.[5] ..... G08B 15/00

[52] U.S. Cl. ..... 340/574; 340/531

[58] Field of Search ..... 340/574, 531

[56] References Cited

U.S. PATENT DOCUMENTS

| | | | |
|---|---|---|---|
| 3,750,131 | 7/1973 | Fletcher | 340/574 |
| 3,928,849 | 12/1975 | Schwarz | 340/515 |
| 4,158,197 | 6/1979 | Takagaki | 340/574 |
| 4,258,352 | 3/1981 | Lipschutz | 340/531 |
| 4,347,501 | 8/1982 | Akerberg | 340/531 |
| 4,535,324 | 8/1985 | Levental | 340/574 |
| 4,602,357 | 7/1986 | Yang et al. | 340/574 |
| 4,764,757 | 8/1988 | DeMarco et al. | 340/574 |

FOREIGN PATENT DOCUMENTS

| | | |
|---|---|---|
| 137337 | 4/1985 | European Pat. Off. . |
| 2712690 | 9/1978 | Fed. Rep. of Germany . |
| 3210002 | 9/1983 | Fed. Rep. of Germany . |
| 3507453 | 9/1986 | Fed. Rep. of Germany . |
| 2260837 | 9/1975 | France . |
| 2080001 | 1/1982 | United Kingdom . |

*Primary Examiner*—Glen R. Swann, III

*Attorney, Agent, or Firm*—Merchant, Gould, Smith, Edell, Welter & Schmidt

[57] ABSTRACT

An infra-red remote personal alarm system consists of a portable transmitter unit (10) which is intended to be worn or to be manually carried by the user, and which is operable by the user at any particular location to transmit an alarm signal in an emergency and which is to be received by a central receiving station (41) so that appropriate action can be initiated in response thereto. The transmitter unit is electrically operable and includes means (15) for transmitting pulsed infra-red alarm signals which can be picked-up by an infra-red signal receiver at the location of the user, and then retransmitted as an oscillating electrical signal via direct wiring (38, 39, 40, 42, 43) to the central receiving station (41) as a warning signal indicative at location monitoring points (43, 44) of the location from which the emergency call has been made. By making the transmitter units capable of transmitting infra-red pulsed warning signals, and suitably designing the receiver units to recognize and to receive the pulse signals for conversion into electrical signals for onward transmission to the central control station, it is possible to obtain transmission units which are robust and reliable in operation. Test facilities are also provided to enable continuous monitoring of the operational status of the transmission units and the receiver units, so as to minimize the risk of initiated emergency action of the transmission units being undetected.

6 Claims, 5 Drawing Sheets

REMOTE INFRA-RED PERSONAL ALARM SYSTEM

BACKGROUND OF THE INVENTION

1. Field of the Invention

This invention relates to a personal alarm system which comprises a portable transmitter unit to be worn about the person, or hand carried, and which is operable in an emergency to transmit an alarm signal which is to be received and processed by a central receiving station so that appropriate action can be initiated in response thereto.

2. Description of the Prior Art

There are many situations in which it is necessary, or advisable, for a portable transmitter unit to be available for use in emergencies, such as by the occupants of sheltered housing schemes, a warden on routine visits to such occupants, or medical personnel in hospitals or other institutions. In these situations, it is important, when an emergency call is received at the central control or command station, that the location from which the emergency call has been made is immediately discernable, and therefore it is usual to locate a dedicated receiver at each location to be monitored e.g. on the wall or ceiling of a room, and for each dedicated receiver to be connectable in any desired manner e.g. radiowave communication or direct electric line connection to the central control station, where the re-transmitted emergency signal will be indicated at the control station as having come from that particular location.

It is known to use ultrasonic personal alarm transmitter units, which issue ultrasonic signals to be received by a dedicated ultrasonic receiver at each location which is to be monitored (which then re-transmits to the central station), but ultrasonic units rely upon crystal devices, which are not robust, and in fact are rather fragile, so that this can cause problems with regard to reliability. In addition, it is a feature of existing ultrasonic transmitters that they cannot readily be tested as to their current state of serviceability while in use, and there is therefore a risk that emergency signals may fail to be issued and/or received.

It is also known to provide each member of staff in a hospital or other people-care type institution with his own radio transmitter unit, for use in emergencies and which transmits a radio signal which is picked-up by a central receiver, and this gives an indication of the caller, but not of the location where the caller has made the emergency call. Therefore, the radio transmitter units are not suitable for use in situations in which the users may be located in any one of a number of different locations when the emergency call has been made.

SUMMARY OF THE INVENTION

The present invention has been developed primarily in connection with a personal alarm system which is able to indicate the location at which an emergency call has been made, and using means which are more reliable than ultrasonic transmitter/receiver units of existing systems.

According to the invention there is provided a personal alarm system which comprises a portable transmitter unit to be worn or to be hand carried by the user, and which is operable by the user at any particular location to transmit an alarm signal in an emergency, such signal being receivable by a central receiving station so that appropriate action can be initiated in response thereto:

in which the transmitter unit is electrically operable and includes means for transmitting pulsed infra-red alarm signals to be monitored by an infra-red signal receiver at the location of use of the transmitter unit, and to be re-transmitted to the central receiving station as a warning signal indicative of the location at which the user has operated the transmitter unit.

Thus, the personal alarm system may be used to particular advantage in hospitals, especially hospital casualty departments, and in institutions for mentally disturbed or handicapped patients, where attacks on medical staff are quite frequent, and in which it is important for the member of staff to be able easily to issue an emergency call which will be picked-up by a suitable receiver at each of any desired monitoring locations, and for the call to be re-transmitted to the central station in a form which will indicate immediately the location from which the call has been made, so that immediate help can be directed to any person under attack.

It should be apparent, however, that the invention is not restricted to such use, and can be employed in any situation in which it is a requirement to be able readily to monitor at a central station the location from which an emergency call has been made.

Preferably, the personal alarm system according to the invention is used in conjunction with a signal receiving system which comprises one or more of said infra-red receivers, each to be located at a respective one of a plurality of desired monitoring locations, and master receiving equipment to be located at a central or control receiving station to receive warning signals re-transmitted from any one of the infra-red receivers.

If a particular location to be monitored is a particularly large area, it may be desirable for more than one infra-red receiver unit to be positionable at such location, in order to ensure that any pulsed infra-red emergency call is received, and then onward-transmitted to the central control station. Conveniently, the infra-red receivers are each wired to a central alarm panel which is able to identify the location of an active transmitter.

By arranging for each transmitter unit to issue pulsed infra-red signals, it is possible to design the transmitter unit and the corresponding infra-red receiver unit so that a predetermined pulse pattern can be readily detected and then recognised, and this will overcome, or at least minimise the risk of any spurious infra-red signals from triggering an alarm signal to the central control station.

To provide a continual reassurance of a proper operation of the transmitter system and the receiver system, it is preferred that a test facility is provided which, by incorporating a low-power transmitter circuit within each receiver unit, enables a complete test of the installation to be activated from the central alarm panel. In addition, all wiring associated with the installation is monitored continuously, creating an alarm condition if a wiring fault or break is detected.

BRIEF DESCRIPTION OF THE DRAWINGS

One embodiment of personal alarm system according to the invention will now be described in detail, by way of example only, with reference to the accompanying drawings, in which.

DETAILED DESCRIPTION OF THE PREFERRED EMBODIMENTS

Figure 1:
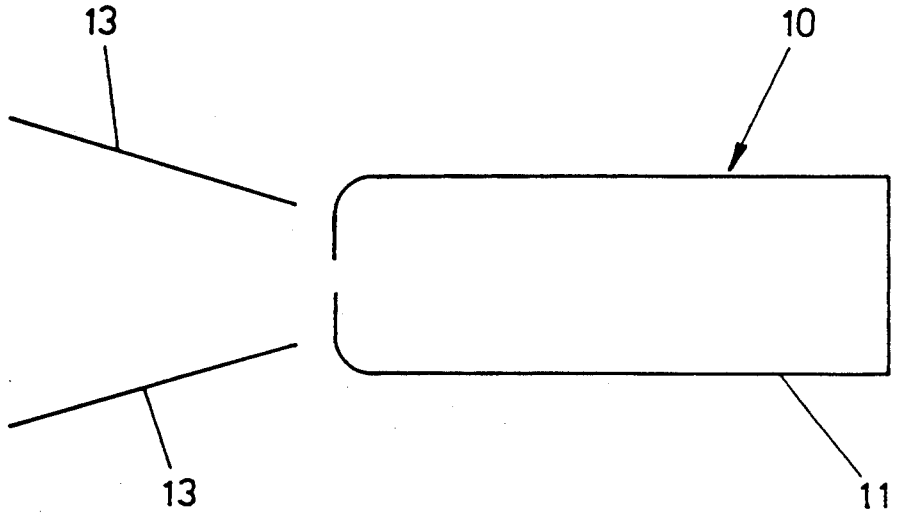
FIG. 1 is a side view of a portable transmitter unit of a personal alarm system, and which is to be worn or to be hand carried by the user.
Figure 2:
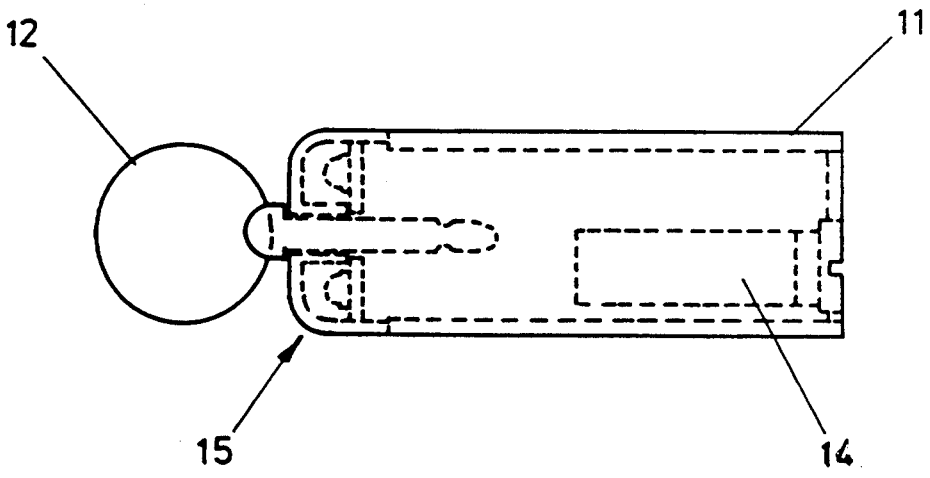
FIG. 2 is a view, similar to FIG. 1, illustrating schematically the internal components of the transmitter unit.
Figure 3:
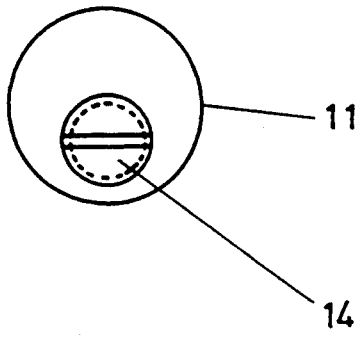
FIG. 3 is an end view of the transmitter unit.

Referring now to FIGS. 1 to 3 of the drawings, a portable infra-red transmitter unit is designated generally by reference 10 and forms part of a personal alarm system, the unit 10 being designed so as to be capable of being worn about the person, or hand carried, according to preference of the user. The transmitter unit 10 is electrically operable, having a battery compartment, so that in an emergency it can transmit an alarm signal which is received initially by any one of a plurality of dedicated receivers arranged at a number of monitoring locations likely to be visited by the user, and then retransmitted to a central receiving station so that appropriate action can be initiated in response thereto. At the central receiving station, any incoming warning signal will be monitored in such a way as to determine the location from which the emergency call has been made by the user with his own personal portable transmitter unit.

Figure 4:
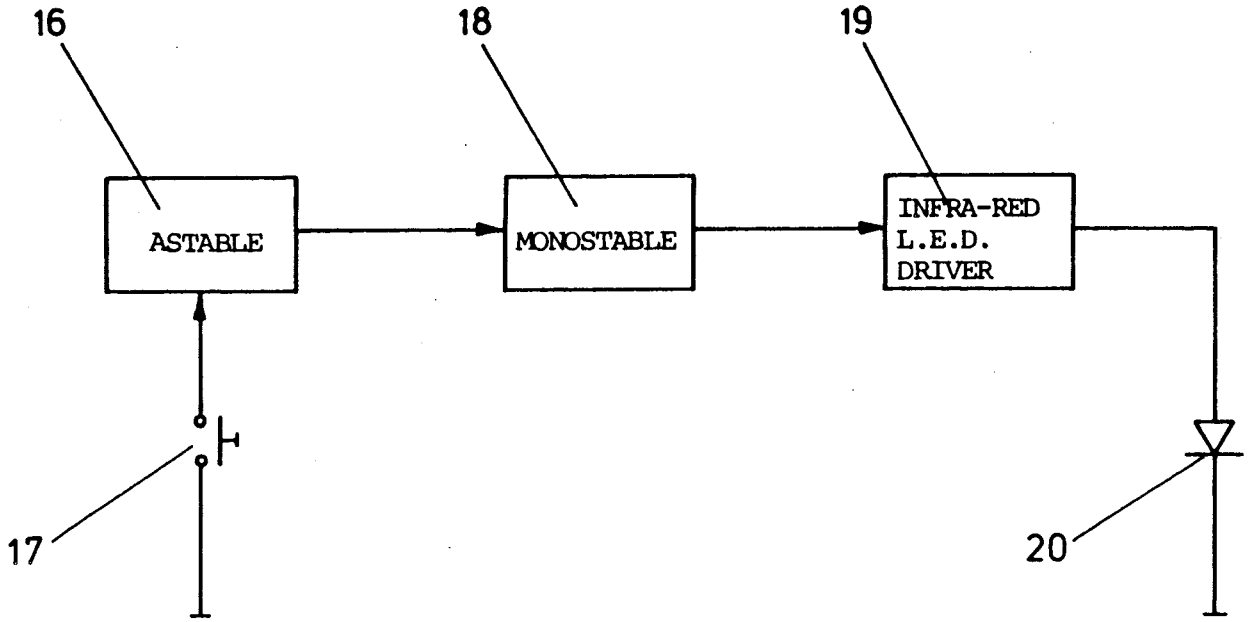
FIG. 4 is a block circuit diagram of the infra-red transmitter unit shown in FIGS. 1 to 3.

The transmitter unit 10 is designed as a compact, lightweight and impact-resistant unit, having a housing 11 designed to hang freely from a belt or key-ring, by means of a spring-retained pin 12. The transmitter unit 10 is activated by withdrawing the housing 11 from the retaining pin 12, and by this action it is ensured that the infra-red beam which is emitted, as shown by beam profile 13 in FIG. 1, is unimpeded by any articles of clothing. The housing 11 incorporates a battery compartment 14 in which a standard miniature 12 volt battery (VR22) is housed in an anti-vibration manner. The forward end of the housing 11 is provided with an LED array of infra-red emitters and an infra-red window, shown schematically by reference 15. The electronic components mounted within the housing 11 are shown in the block circuit diagram of FIG. 4. As shown in the block diagram of FIG. 4, the electronic components include an astable multivibrator circuit 16 triggered into operation by an activation switch 17, a monostable multivibrator circuit 18, an infra-red LED driver 19 and an infra-red LED array 20. The astable and monostable multivibrator circuits 16 and 18 are arranged to produce a continuous train of five microsecond pulses at 4.67 millisecond intervals. The pulse train is then fed to driver 19, which is a MOSFET driver, and then to the LED array 20, which comprises a series-parallel combination of high-power infra-red emitters. Therefore, upon emergency operation of the transmitter units 10, a pulsed infra-red output of predetermined pattern can be transmitted, and which can be recognised and received by any one of the infra-red receiver units arranged at the various monitoring locations as required.

Figure 5:
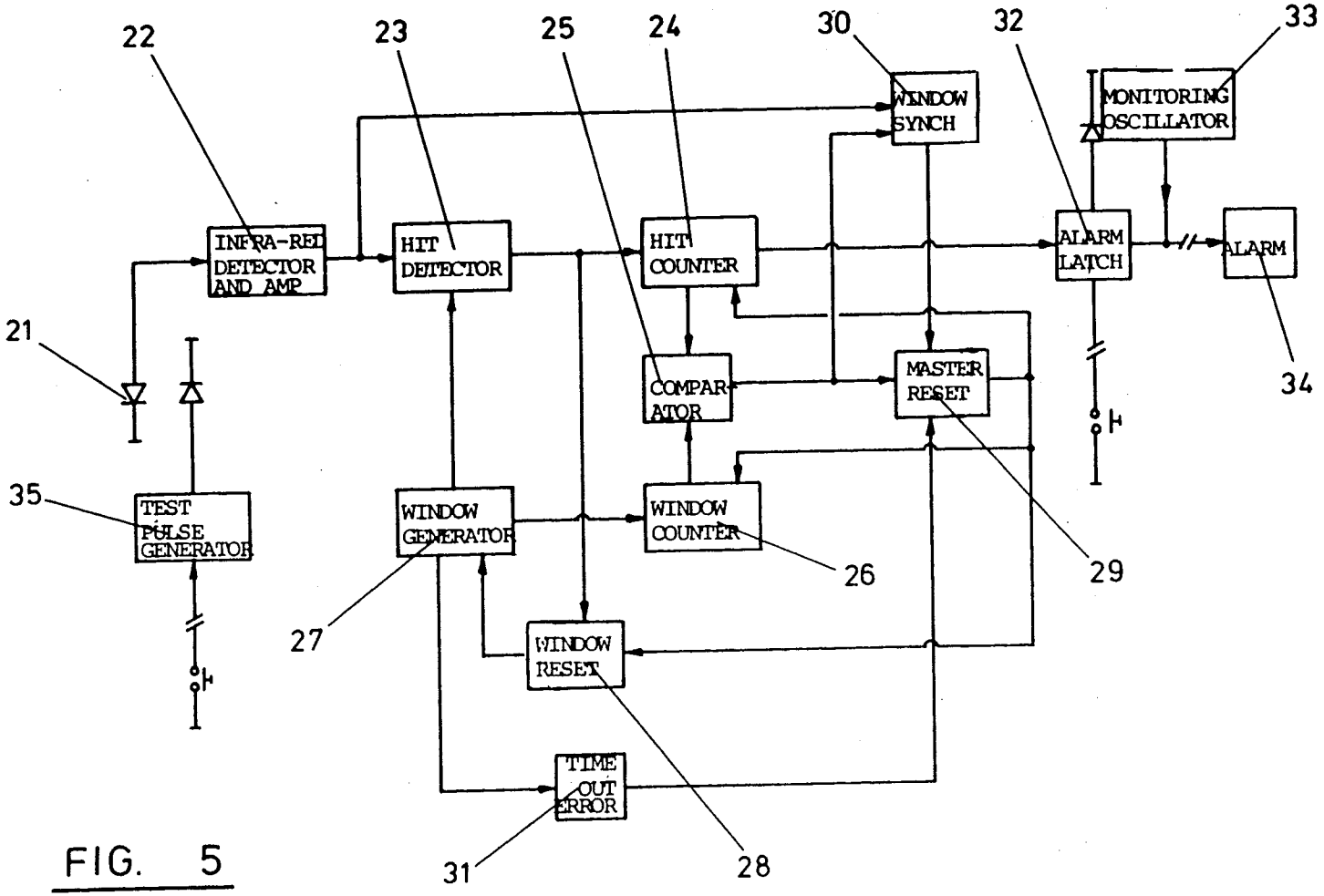
FIG. 5 is a block circuit diagram of an infra-red receiver unit forming part of a receiving system to be used with the portable-transmitter unit of the personal alarm system shown in FIGS. 1 to 4.

Referring now to FIG. 5, this illustrates a block diagram of any one of the infra-red receivers. The infra-red receiver comprises a photo diode 21 forming an input to the receiver, for receiving pulsed infra-red signals from any one of the infra-red transmitter units, an infra-red detector and AMP 22, a hit detector 23, a hit counter 24, a comparator 25, a window counter 26, a window generator 27, a window reset 28, a master reset 29, a window synch 30, a time out error circuit 31, an alarm latch 32, a monitoring oscillator 33, ah alarm 34, and a test pulse generator 35.

Infra-red pulses received by photo diode 21 from an active transmitter unit, or from the integral self-test circuit provided by test pulse generator 35, are received by the detector 22 and dedicated amplifier ic (SL 486 constrained to fixed-gain operation), and then passed to the subsequent decoding circuitry. The window generator 27 comprises an oscillator and multi-stage counter, the generated output being an initial delay of 4.6 milliseconds, followed by a window pulse of 148 microseconds. Transmitter pulses fall within successive windows, each window being triggered by the previously received pulse, via the window reset 28. This synchronisation technique effectively discriminates against any other sources of infra-red radiation which could give rise to spurious signals. The window counter 26 is incremented whenever a window is generated. The hit detector 23 passes pulses which arrive within a time window through to the pulse hit counter 24. The alarm latch 32 is set when the hit counter reaches a pre-set number, and the alarm signal from alarm 34 remains active until manually reset from the central alarm panel at the control station.

The count comparator 25 notifies the master reset circuit 29 of any discrepancy between the window and hit counters i.e. when no infra-red pulse is received during a time window. The master reset circuit 29 causes a reset of the hit counter 24 and the window counter 26 and initiates the start of the next time window, via the window reset 28.

The window synchronisation circuit synchronises the generation of time windows to an incoming pulse train, and this circuit is active immediately following a window comparator pulse i.e. following a "miss" in any time window.

The time-out error circuit 31 ensures that a system master reset pulse will be generated, even in the event of a temporary receiver malfunction. Such malfunctions, although rare, may be caused by electro-magnetic interference or electrical noise in the installation.

Figure 6:
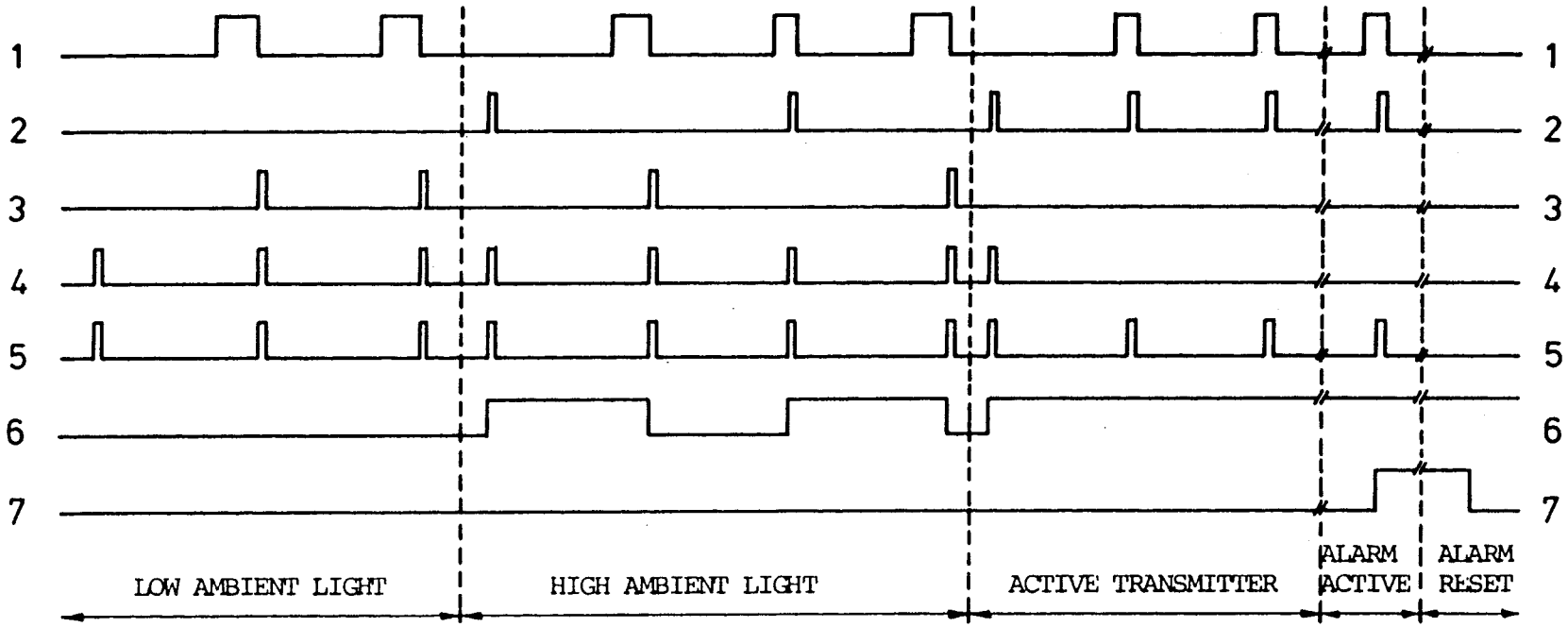
FIG. 6 shows graphs of timing diagrams of the operating components of the alarm transmitting and alarm receiving systems disclosed herein; and, FIG. 7 illustrates a circuit diagram of the connections from remote infra-red receiver units to a central alarm panel at a central control station.

The principles of operation of the components thus far described will now be described with reference to FIG. 6, which shows three modes of operation, illustrated in the timing diagrams of FIG. 6. The diagrams illustrate the pulse characteristics, via lines 1 to 7, in which line 1 is the window generator, line 2 is the infra-red detector, line 3 is the comparator, line 4 is the master reset, line 5 is the window reset, line 6 is the window synch, and line 7 is the alarm latch. The three possible modes of operation which are normally possible are as follows:

1. Detection of an active transmitter.

The hit detector latch is enabled as each generated window opens. A pulse from an active transmitter sets the latch and fires a monostable. The monostable pulse thereby formed then increments the hit counter, causing a window generator reset and disables the hit detactor latch. During the window delay period, therefore, incoming infra-red pulses are rejected. After the window delay period, the next window opens, incrementing the window counter and re-enabling the hit detector latch. The anticipated transmitter pulse now sets the latch and refires the monostable, which again increments the hit counter and initiates another timing cycle. With successive transmitter pulses, the hit and window counters increment in steps. The alarm latch is set when the hit counter has accumulated a preset number of counts.

2. Operation in the dark.

If a window opens and closes without receiving an input pulse, a discrepancy occurs between the hit and window counters. The comparator, which is sampled at the end of each window cycle, becomes active and generates a master reset pulse. This resets the hit and window counters and also resets the window generator. In the absence of infra-red signals, the circuit will continue to produce empty timing windows and master reset pulses.

3. Receiver-transmitter synchronisation.

Following the occurrence of an empty window, an input latch in the window synchronisation circuit is enabled by the active comparator. If an infra-red pulse arrives during the window delay period, this latch is set and a master reset is generated. Hence, if the pulse is the first of a train of transmitter pulses, the window generator will be correctly synchronised to the transmitter frequency.

The system incorporates test facilities, to enable continuous reassurance of safe operation of the system is available.

Thus, each receiver has a test circuitry arranged to generate a low power infra-red pulse train at an identical frequency to that of one of the transmitter units. The circuit can be activated from the central alarm panel, so that all receivers in the installation are tested simultaneously. By simulating an active transmitter, the facility provides a complete test of each receiver unit.

Concerning the transmitter units, a test unit, based on a modified receiver circuit, is used to test the output power and pulse repetition frequency of each transmitter unit, before issue to personnel.

The infra-red receiver units receive and recognise pulsed infra-red input signals, derived from operation on emergency call of any one of the infra-red transmitter units, and then re-transmits the emergency call via direct electrical wiring to a central control panel at the control or master station. Thus, each receiver unit transmits an oscillating electrical signal, which is inhibited by the alarm latch, via the alarm signal cable to the central control panel. If the oscillations cease, the central control panel signals an alarm/fault condition. This system provides a continuous monitoring of the integrity if both the power and the signal cabling of the installation.

Figure 7:
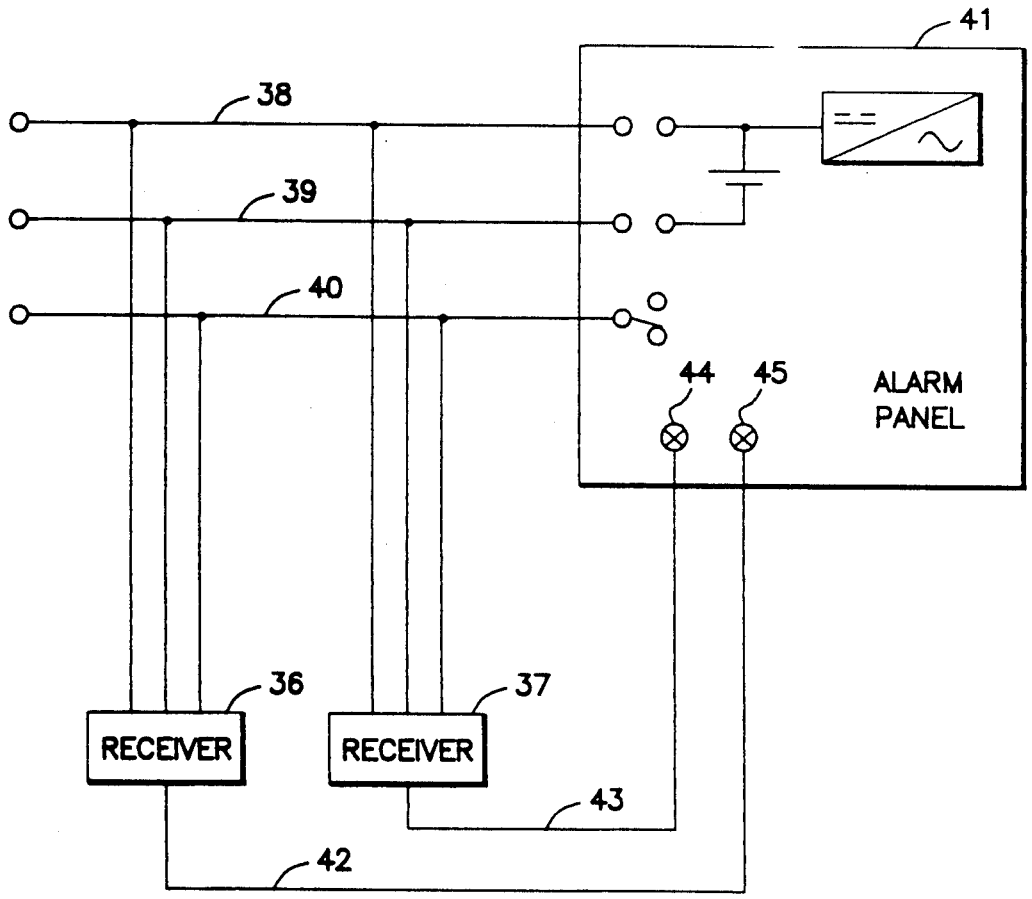

Referring finally to FIG. 7 of the drawings, this shows the installation requirements for connection of the infra-red receivers via direct wiring to the central control panel. For illustration purposes only, two receiver units only are shown, comprising receiver 36 and receiver 37, and these are connected to low voltage supply and return cables 38 and 39, the installation operating under 13.5 volts supply. A test/reset cable daisy chain 40 also extends to all of the receiver units. A single cable from each receiver carries an alarm/monitor signal to the central alarm panel 41, and as shown cable 42 connects receiver 36 to an input indication point 43 on the control panel, at which an alarm or fault indication can be given, depending upon whether the test facility is being operated, or a genuine alarm call has been made from a transmitter unit having its infra-red output accessible to the input of any one of the receiver unit(s) at receiver 36. Similarly, cable 43 connects receiver 37 to an alarm/fault indication point 44 on the control panel.

The system specification of a preferred embodiment is as follows:

| | |
|---|---|
| 1. Transmitter | |
| Pulse repetition frequency | 214 Hz |
| Pulse width | 5 μs |
| Peak wavelength emission | 950 nm |
| Size | |
| length | 75 mm |
| diameter | 26 mm |
| Weight (including battery) | 60 g |
| Battery type | VR-22 or equivalent |
| Battery life (continuous) | 45 minutes approx |
| Infra-red beam profile | 80% power in ± 16. |
| 2. Receiver | |
| Range (line of sight) | 20 meters minimum |
| Power consumption (including indicator led) | 100 mA approx at 12V |

We claim:

1. A personal alarm system which comprises a portable transmitter unit (10) to be worn or manually carried by the user, and which is electrically operable by the user at any particular location to transmit an alarm signal in an emergency which is to be received by a central receiving station (41) so that appropriate action can be initiated in response thereto, the transmitter unit (10) including means (15) for transmitting pulsed infra-red alarm signals to be monitored by an infra-red signal receiver (36, 37) at said location and to be re-transmitted to the central receiving station (41) as a warning signal indicative of the location at which the user has made the emergency call characterized in that the infra-red receiver (36, 37) comprises discriminating means for discriminating between spurious infra-red signals and signals transmitted by the transmission unit (10) the discriminating means including means for recognizing and detecting a predetermined pulse pattern.

2. An alarm system according to claim 1, characterized by a plurality of infra-red receivers (36, 37) adapted to be mounted at a plurality of said locations.

3. An alarm system according to claim 2, characterized in that said infra-red receivers (36, 37) are connected by electric lines (38, 39, 40, 42, 43) to said central receiving station (41).

4. An alarm system according to any one of claims 1 to 3, characterised in that the transmitter unit (10) comprises a housing (11) having a spring-loaded retaining pin (12) for attaching the unit (10) to the user, release of which causes automatic triggering into operation of the unit to emit pulsed infra-red signals in an emergency.

5. A personal alarm system according to claim 1 or claim 2 wherein the discriminating means comprises a detector and amplifier (22) for detecting a pulsed signal from the transmitter unit (10) and decoding circuitry in communication with said detector and amplifier.

6. A personal alarm system according to claim 5 wherein the decoding circuitry comprises: a hit detector (23) connected to the detector and amplifier (22), a hit counter (24) connected to the hit detector (23); a window counter (26) and window generator 27, connected to one another and to the hit detector (23); a comparator (25) in series with the hit counter (24), and the window counter for detecting any discrepancy between the window and the hit counters; a master reset (29) connected to the comparator (25); a window synch (30) connected to the detector and amplifier (22) and the comparator (25) for synchronising the generation of time windows to an incoming pulse train; a time out error (31) connected to the window generator; an alarm latch (32) connected to the hit counter (24), and a test pulse generator (35) for generating test pulses to test the circuit.

* * * * *